US008800805B2

(12) United States Patent
Gao et al.

(10) Patent No.: US 8,800,805 B2
(45) Date of Patent: Aug. 12, 2014

(54) HIGH VACUUM CONTAINER AND ADJUSTING DEVICE

(71) Applicants: Zhangjiagang CIMC Sanctum Cryogenic Equipment Co., Ltd., Zhangjiagang (CN); China International Marine Containers (Group) Ltd., Shenzhen (CN)

(72) Inventors: Jie Gao, Zhangjiagang (CN); Wei Wei, Zhangjiagang (CN); Hongwei Liu, Zhangjiagang (CN); Haoming Wang, Zhamgkoagang (CN); Jia Lu, Zhangjiagang (CN); Si Wang, Zhangjiagang (CN); Sen Yao, Zhangjiagang (CN)

(73) Assignees: China International Marine Containers (Group) Ltd., Shenzhen (CN); Zhangjiagang CIMC Sanctum Cryogenic Equipment Co., Ltd., Zhangjiagang (CN)

( * ) Notice: Subject to any disclaimer, the term of this patent is extended or adjusted under 35 U.S.C. 154(b) by 0 days.

(21) Appl. No.: 13/736,366

(22) Filed: Jan. 8, 2013

(65) Prior Publication Data

US 2013/0228489 A1 Sep. 5, 2013

(30) Foreign Application Priority Data

Mar. 2, 2012 (CN) ..... 2012 2 0076392 U

(51) Int. Cl.
*F17C 1/00* (2006.01)
*F17C 1/02* (2006.01)

(52) U.S. Cl.
USPC ..... 220/586; 220/560.1; 220/560.11; 220/581; 220/592

(58) Field of Classification Search
CPC ..... B65D 81/00; B65D 90/028; F17C 1/00; F17C 2203/0636; F17C 2260/011; F17C 2203/014
USPC ..... 220/23.89, 506, 560.1, 560.11, 581, 220/586, 592
See application file for complete search history.

(56) References Cited

U.S. PATENT DOCUMENTS 4,156,492 A * 5/1979 Cavanna et al. ..... 220/560.1

* cited by examiner

*Primary Examiner* — Fenn Mathew
*Assistant Examiner* — Madison L Poos
(74) *Attorney, Agent, or Firm* — Fox Rothschild LLP

(57) ABSTRACT

A high vacuum container includes an inner container body, an outer container body, a first group of supporting devices and a second group of supporting devices. Each group of supporting devices includes four supporting assemblies, and two supporting assemblies are disposed at the upper portion of the high vacuum container, and the other two are disposed at the lower portion of the high vacuum container. Each supporting assembly includes a base plate welded at outer surface of the inner container body and a heat insulating pipe extending along a radial direction of the high vacuum container, one end of the heat insulating pipe abutting against the base plate. Each supporting assembly at the lower portion further includes a fixing element, and each fixing element partly is partly inserted into the outer container body through the opening on the outer container body. Each fixing element has a top plate and a bending portion, and each bending portion bends vertically from the edge of the top plate and towards the inner part of the high vacuum container, and sleeves onto outside of the heat insulating pipe, and outer surface of the bending portion is welded to the outer container body at the opening. The high vacuum container and an adjusting device for adjusting the concentricity of the high vacuum container would be beneficial to high concentricity.

8 Claims, 5 Drawing Sheets

HIGH VACUUM CONTAINER AND ADJUSTING DEVICE

CROSS-REFERENCE TO RELATED APPLICATIONS

The present application claims priority to Chinese Patent Application Serial No. 201220076392.6, filed on Mar. 2, 2012, the contents of which are hereby incorporated by reference.

FIELD OF THE INVENTION

The invention relates to a high vacuum container and an adjusting device, more particularly, to a high vacuum container with high concentricity between an inner container body and an outer container body and an adjusting device thereof.

BACKGROUND OF THE INVENTION

A high vacuum container includes an outer container body and an inner container body. When the outer container body is sleeved onto outside of the inner container body to form the high vacuum container, the position accuracy of the inner container inside the outer container body should be high to ensure the concentricity of the outer container body and the inner container body.

FIG. 1 is an assembling schematic diagram showing a conventional high vacuum container consisted of the inner container body and the outer container body. As shown in FIG. 1, an eight-point positioning method is used to position the inner container body 2' inside the outer container body 1' of the conventional high vacuum container, including the following steps:

(1) fixing the outer container body 1' with several openings H' defined onto the wall thereof and placing rails R inside the outer container body 1';

(2) pushing a rail tooling 3' against left side end cover 21' and a movable tooling 4' against right side end cover 22' of the inner container body 2' respectively, and then moving the inner container body 2' by the rail tooling 3' along the rails R laid on the bottom wall of the outer container body 1' and the movable tooling 4' hanged up along the direction A in FIG. 1, so as to the inner container body 2 is sleeved into the outer container body 1', (3) after placing the inner container body 2' into the accommodating space of the outer container body 1' by the rail tooling 3' and the movable tooling 4', then adjusting the relative position of the inner container body 2' to the outer container body 1' by adjusting the position of the rail tooling 3' against the left side end cover 21', thereby achieving the centralized positioning, (4) fixing the relative position of the inner container body 2' to the outer container body 1' by eight supporting assemblies 5' of the high vacuum container as shown in FIG. 2).

FIG. 2 is a sectional diagram showing the inner container body 2' and the outer container body 1' of the high vacuum container after assembling in FIG. 1. Only four supporting assemblies are shown in FIG. 2. The eight supporting assemblies 5' of the high vacuum container are divided into two groups along the axis thereof, and four supporting assemblies 5' in each group are arranged around the circumference of the inner and outer container bodies. Each supporting assembly 5' includes a base plate 51', an upper fixing pipe 52', a heat insulating pipe 53' and a cover plate 54', and the supporting assemblies in the group at the rear portion of the high vacuum container further includes a lower fixing pipe 55'.

As shown in FIG. 1, before step (2), the base plate 51' is welded onto the front portion of the inner container body 2'. But, for the supporting assemblies 5 at the rear portion of the high vacuum container, the base plates 51' with the lower fixing pipes 55' welded thereonto are welded onto the rear portion of the inner container body 2'. After the inner container body 2' is transported to a predetermined place, the positions of the base plates 51' is corresponding to those of the openings H' of the outer container body 1'. Then, a heat insulating pipe 53' with a predetermined length is inserted through each opening H' of the outer container body 1' to abut against the base plate 51', and for the group of supporting assemblies 5' at the rear portion of the high vacuum container, the heat insulating pipes 53' are inserted into the lower fixing pipes 55'. Then, the upper axing pipes 52' welded with cover plate 54' is inserted through the openings H, and the cover plate 54' covers the outer surface of the outer container body 1', and the heat insulating pipe 53' is inserted in the upper fixing pipe 52'. Thereby, the assembling and positioning process of the high vacuum container is finished.

The heat insulating pipes 53' are arranged along the radial direction of the inner container body and the outer container body, and the length of the heat insulating pipe 53' is predetermined from the theoretical calculation. For example, the length is half of the difference between the diameter of the outer container body and the diameter of the inner container body. In practical application, the eight-point positioning method has drawbacks as follows: because of the length of the heat insulating pipe being deduced from theoretical calculation, during the assembling process, the concentricity of the inner container body and the outer container body cannot be adjusted due to operation and manufacture errors, and the concentricity can not meet the requirement of tolerance in the scope of ≤±5 mm.

SUMMARY OF THE INVENTION

One object of the invention is to solve the problem that the conventional technology cannot meet the concentricity requirement of tolerance in the scope of ≤±5 mm, and provides a high vacuum container which can meet the concentricity requirement and its adjusting device.

To solve the problem above, the invention provides a high vacuum container includes an inner container body, an outer container body, a first group of supporting devices and a second group of supporting devices, the outer container body being provided with a plurality of openings corresponding to the first group of supporting devices and the second group of supporting devices. Each group of the supporting devices including four supporting assemblies around circumference of the high vacuum container, and two said supporting assemblies being disposed at upper portion of the high vacuum container, and the other two said supporting assemblies being disposed at lower portion of the high vacuum container. Each supporting assembly including a base plate welded at outer surface of the inner container body and a heat insulating pipe extending along a radial direction of the high vacuum container, one end of the heat insulating pipe abutting against the base plate. The four supporting assemblies at the lower portion of the high vacuum container further include four fixing elements respectively, and each fixing element is partly inserted into the outer container body through the opening. Each fixing element includes a top plate and a bending portion, and the bending portion bends vertically from the edge of the top plate and towards inner part of the high vacuum container, and sleeves onto outside of the heat insulating pipe, and outer surface of the bending portion is welded to the outer container body at the opening.

In a preferred embodiment of the invention, each of the two supporting assemblies in each group of the supporting devices at upper portion of the high vacuum container comprises an upper fixing pipe and a cover plate, and the upper fixing pipe is welded to the cover plate, and the cover plate is welded to and conformably covers the outer surface of the outer container body, and the upper fixing pipe goes through the opening of the outer container body, and sleeves onto outside of the other end of the heat insulating pipe.

In a preferred embodiment of the invention, four supporting assemblies in the first group of supporting devices are disposed at the rear portion of the high vacuum container, and each of the supporting assemblies in the first group further comprises a lower fixing pipe, which is welded at the base plate and sleeves onto outside of said one end of the corresponding heat insulating pipe In a preferred embodiment of the invention, the supporting assemblies in one group at the upper portion of the high vacuum container are positioned respectively with an angle of 45° or 135° relative to a horizontal center line of the high vacuum container, and the supporting assemblies in one group at the lower portion of the high vacuum container are positioned respectively with an angle of −60° or −120° relative to the horizontal center line of the high vacuum container.

In a preferred embodiment of the invention, each fixing element is a hollow pillar with the top plate and a side wall.

The invention also discloses an adjusting device for adjusting a concentricity of an inner container body relative to an outer container body of a high vacuum container above. The adjusting device includes a bracket and an elevating part which is capable of raising and lowering the fixing element, the bracket is disposed at the outer part of the lower portion of the outer container body of the high vacuum container, and the elevating part pushes against the top plate of the fixing elements and drives the fixing elements to move.

The invention replaces the un-adjustable eight-point supporting devices with an adjustable supporting structure at the lower portion of the high vacuum container, ensures the concentricity of the inner container body and the outer container body and reduces the affection to the concentricity caused by different kinds of error.

DETAILED DESCRIPTION OF THE PREFERRED EMBODIMENTS

To achieve the object above, the invention provides a high vacuum container and an adjusting device which can meet the concentricity requirement.

Figure 1:
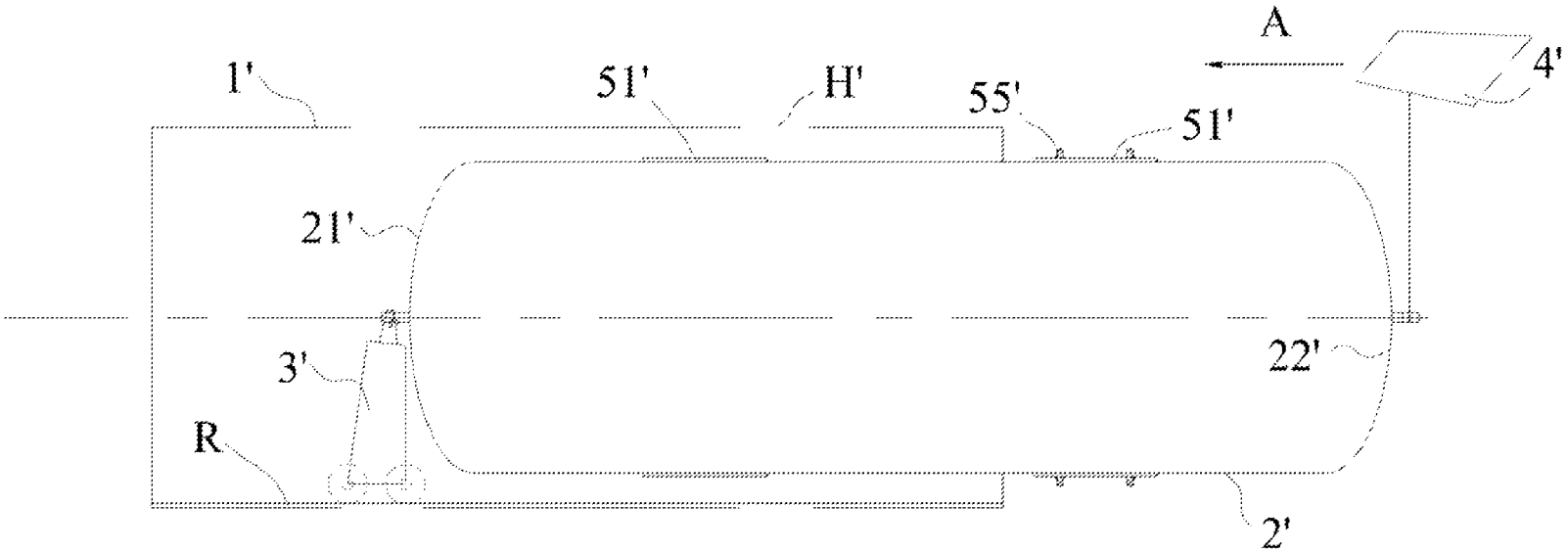
FIG. 1 is an assembling schematic diagram showing the conventional high vacuum container formed by the inner container body and the outer container body
Figure 2:
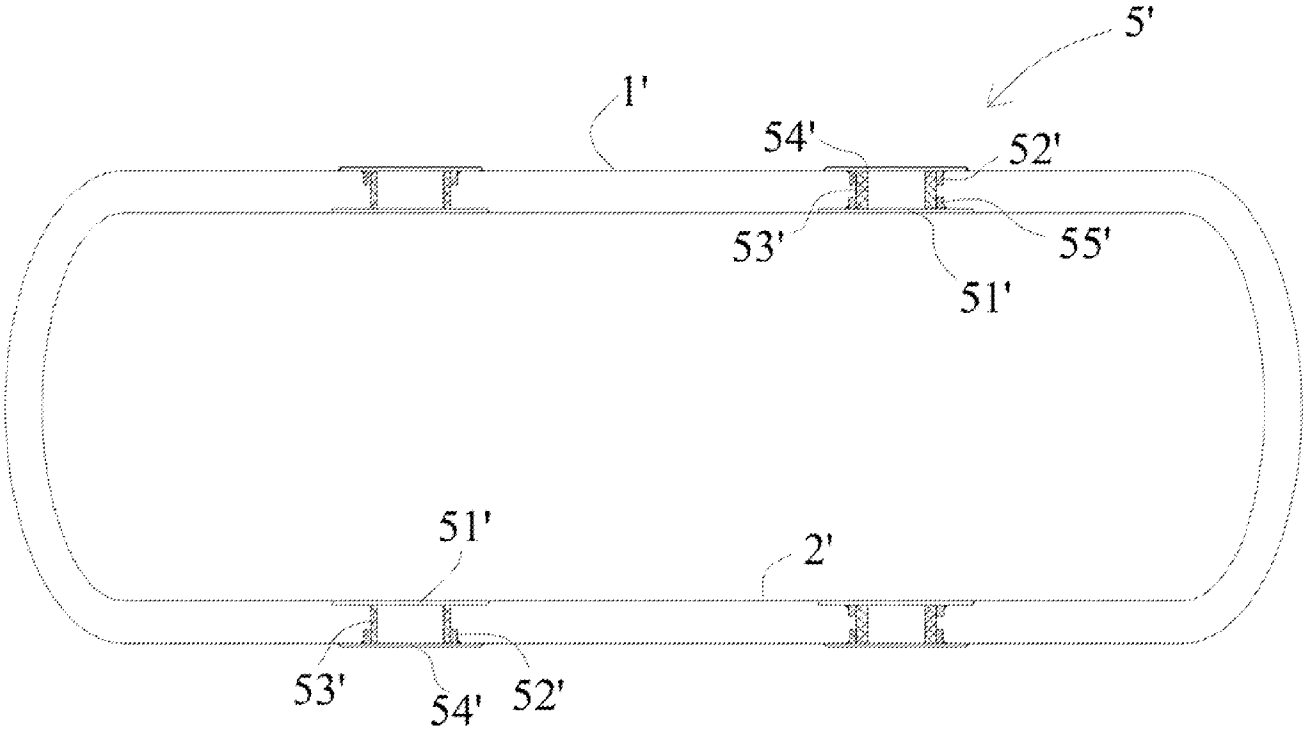
FIG. 2 is a sectional diagram showing the assembled conventional high vacuum container in FIG. 1.
Figure 3:
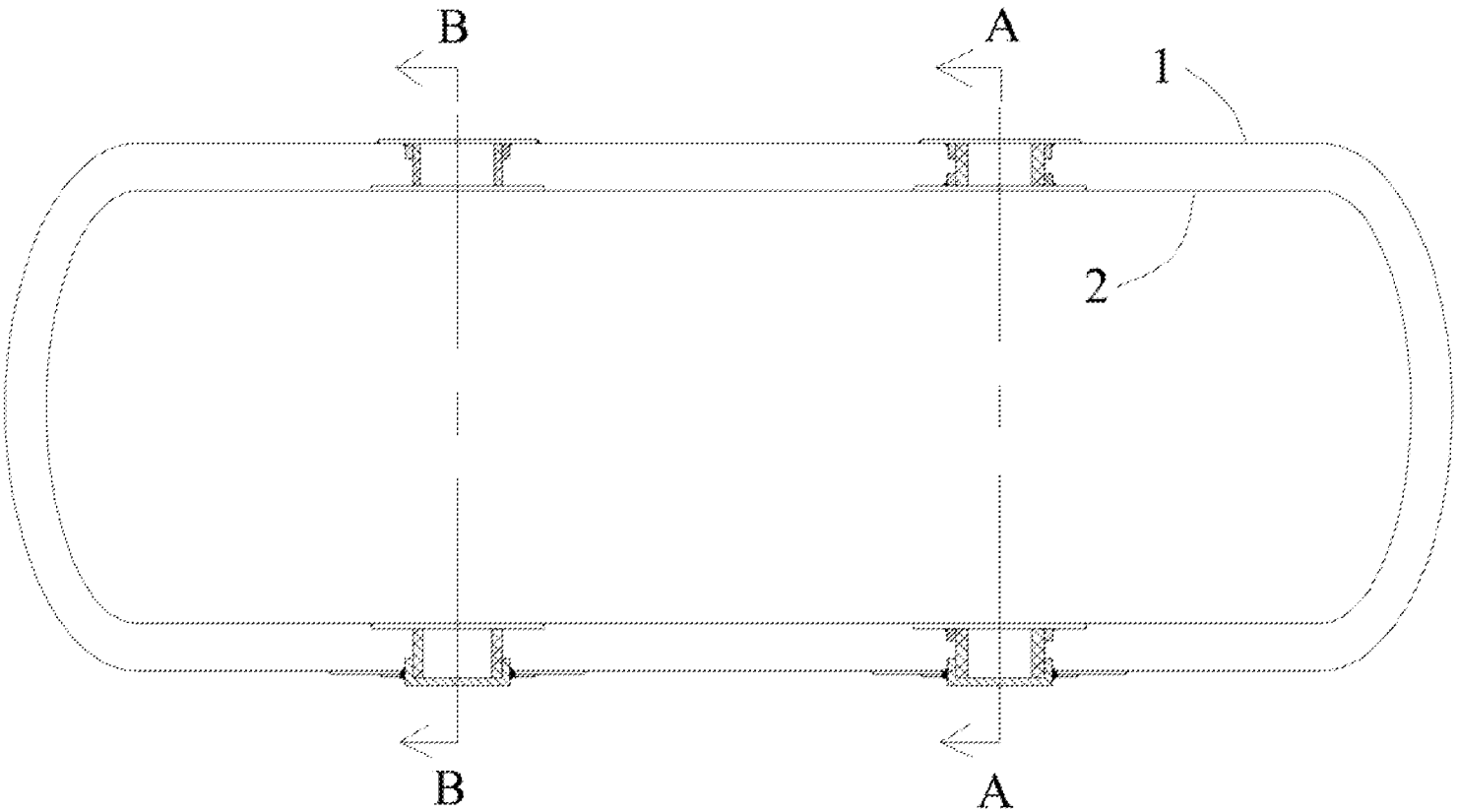
FIG. 3 is a sectional diagram showing the high vacuum container in an embodiment of the invention.
Figure 4:
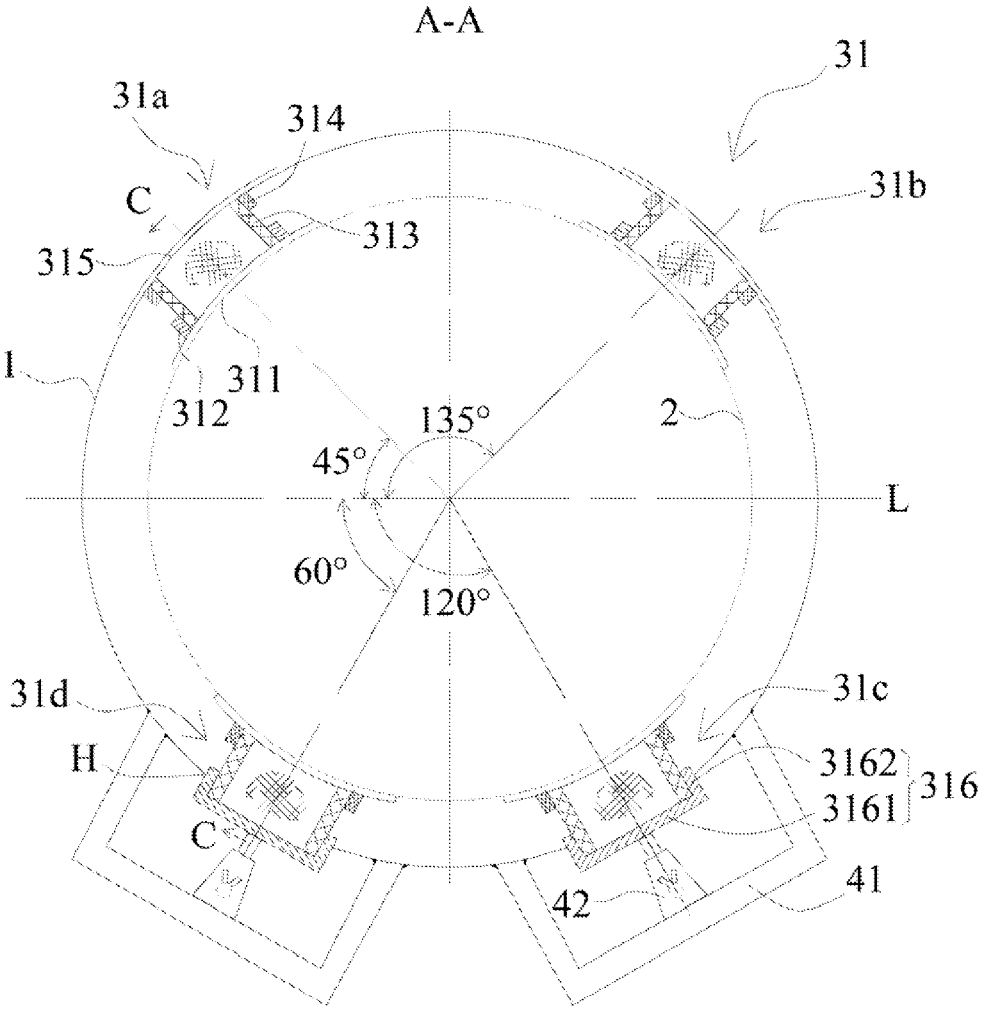
FIG. 4 is a sectional diagram taken along, line A-A in FIG. 3.
Figure 5:
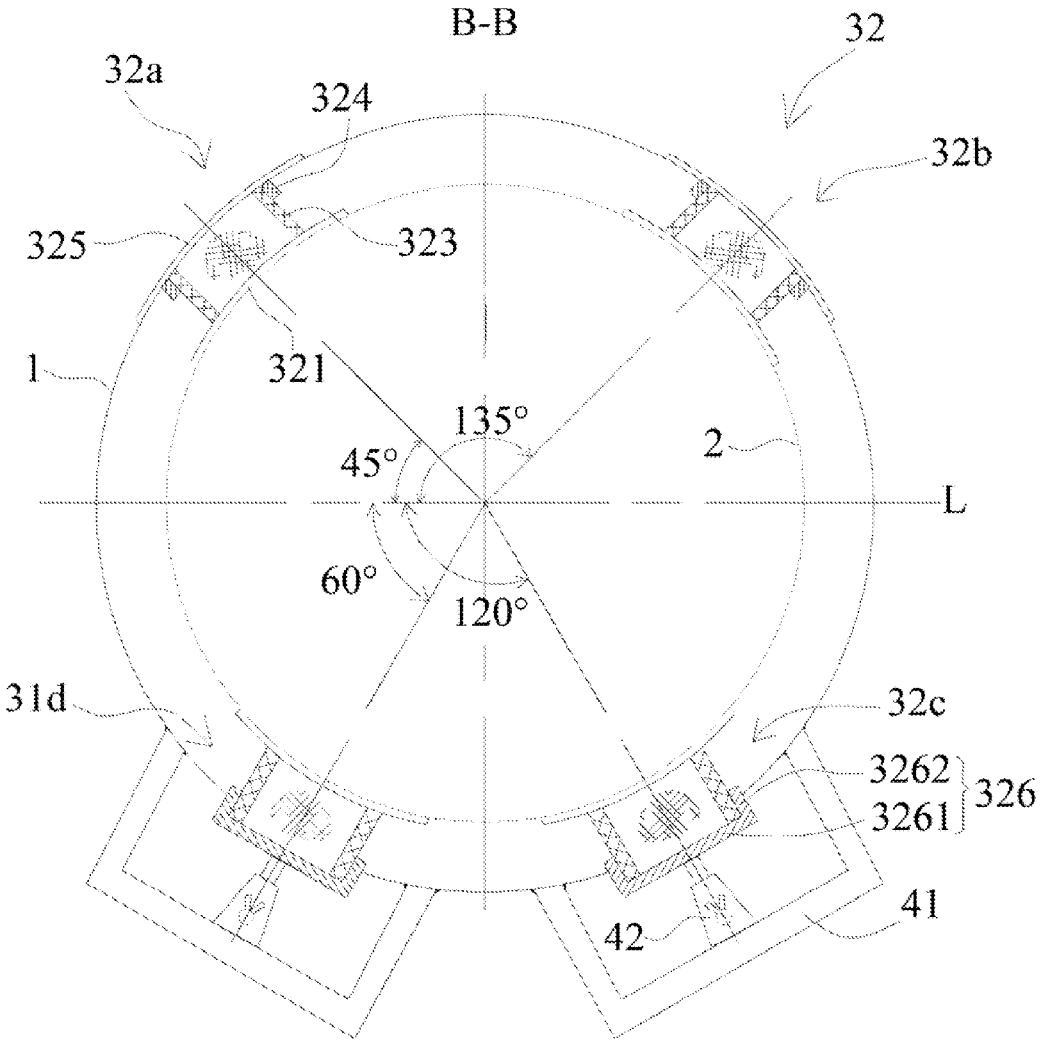
FIG. 5 is a sectional diagram taken along line B-B in FIG. 3.

FIG. 3 is a sectional diagram along line C-C in FIG. 4, showing the high vacuum container in an embodiment of the invention. As shown in FIG. 3, the embodiment of the invention provides a high vacuum container including an outer container body 1, an inner container body 2, and a front group of supporting devices, a rear group of supporting devices, a front group of adjusting devices and a rear group of adjusting devices. FIG. 4 is a sectional diagram along line A-A in FIG. 3, and FIG. 5 is a sectional diagrams taken along line B-B in FIG. 3. As shown in FIG. 4 and FIG. 5, the front group of supporting devices and the rear group of supporting devices are arranged along the axis of the inner container body 2, and the rear group of supporting devices is a first group of supporting devices 31 at the rear portion (shown in FIG. 4), and the front group of supporting devices is a second group of supporting devices 32 at the front portion (shown in FIG. 5). In the embodiment of the invention, the first group of supporting devices 31 includes four supporting assemblies 31*a* to 31*d* and the second group of supporting devices 32 includes four supporting assemblies 32*a* to 32*d* around the circumference of the inner and outer container bodies. The four supporting assemblies 31*a*, 31*b*, 32*a* and 32*b* are disposed at the upper portion of the high vacuum container, and the other four supporting assemblies 31*c*, 31*d*, 32*c* and 32*d* are disposed at the lower portion of the high vacuum container. The supporting assemblies are used to support and fix the inner container body 2 in the outer container body 1. Two groups of our adjusting devices are fixed at the lower portion of outside of the outer container body 1. Each adjusting device includes a bracket 41 and an elevating part 42, and the positions of the adjusting devices correspond to the supporting assemblies 31*c*, 31*d*, 32*c* and 32*d* at the lower portion of the high vacuum container.

FIG. 4 shows the first group of supporting devices 31 at the rear portion of the inner container body 2. As shown in FIG. 4, the first group of supporting devices 31 includes four supporting assemblies 31*a* to 31*d* which are disposed at the upper portion and the lower portion of the high vacuum container respectively and arranged around the circumference of the high vacuum container. The supporting assemblies 31*a* and 31*b* are symmetrically arranged at the upper portion of the high vacuum container, and each of supporting assemblies 31*a* and 31*b* includes a base plate 311, a lower fixing pipe 312, a heat insulating pipe 313, an upper fixing pipe 314 and a cover plate 315. The base plate 311 is welded to the outer surface of the inner container body 2 in advance, and a lower fixing pipe 312 is welded onto the base plate 311 along the radial direction of the high vacuum container. After the inner container body 2 is disposed in the outer container body 1, the heat insulating pipes 313 are inserted through the openings H of the outer container body 1, and are inserted in the lower fixing pipes 312. The upper fixing pipes 314 are welded at the cover plates 315, and are inserted through the openings H to sleeve onto the other end of each heat insulating pipe 313 so that the cover plate 315 covers the outer surface of the outer container body 1 and then is welded onto the outer surface of the outer container body 1.

The supporting assemblies 31*c* and 31*d* are symmetrically arranged at the lower portion of the high vacuum container. Each of the supporting assemblies 31*c* and 31*d* includes a base plate 311, a lower fixing pipe 312 and a heat insulating pipe 313. The structure and connecting manner of the supporting assemblies 310 and 31*d* are the same as those of the base plates 311, the lower fixing pipes 312 and the heat insulating pipes 313 of the supporting assemblies 31*a* and 31*b* at the upper portion. The difference is that each of the supporting assemblies 31*c* and 31*d* at the lower portion includes neither an upper fixing pipe 314 nor a cover plate 315, but includes a fixing element 316. The fixing element 316 is inserted through the opening H of the outer container body 1 and partly embedded in the high vacuum container, sleeving onto outside of the lower end of the heat insulating pipe 313. The fixing element 316 includes a top plate 3161 and a bending portion 3162, the bending portion 3162 extends vertically from the edge of the top plate 3161 and towards the inner part of the high vacuum container, sleeving onto outside of the heat insulating pipe 313. The outer surface of the bending portion 3162 abuts against the opening H of the outer container body 1. In a preferred embodiment, the fixing element is preferably a hollow cylinder with a top plate and a side wall. The side wall matches with the opening H, and the outer surface of the side wall is welded and fixed to the opening H of the outer container body 1. The bracket 41 of the adjusting device is welded at the outer part of the outer container body 1 to make the outer container body 1 stably disposed at a base. The elevating part 42 fixed in the bracket 41 abuts against the top plate 3161 of the fixing element 316. The elevating part 42 drives the fixing element 316, the heat insulating pipe 313 and the inner container body 2 to move upward or downward, thereby adjusting the relative position of the inner container body 2 to the outer container body 1. In practical application, the bending portion 3162 of the fixing element has enough length for about ±40 mm adjusting allowance, to achieve the centralized positioning between the inner container body and the outer container body accurately.

FIG. 5 is a schematic diagram showing the second group of supporting devices 32 at the front portion of the high vacuum container. As shown in FIG. 5, the supporting devices 32 in the second group at the front portion of the inner container body 2 are similar with the supporting devices 31 in the first group, and the supporting devices 32 in the second group also include four supporting assemblies 32*a* to 32*d* which disposed at the upper and lower portion of the high vacuum container respectively and arranged around the circumference of the inner and outer container bodies. Each of the supporting assemblies 32*a* and 32*b* includes base plate 321, a heat insulating pipe 323, an upper fixing pipe 324 and a cover plate 325. Each of the supporting assemblies 32*c* and 32*d* at the lower portion includes a base plate 321, a heat insulating pipe 323 and a fixing element 326. The difference is that no lower fixing pipes are welded onto the base plate 321 in the supporting devices 32 in the second group. As a result, when the inner container body 2 is disposed inside the outer container body 1, the front portion of the inner container body 2 can have slight deformation relative to the outer container body 1, thereby eliminating the temperature stress due to the heat-expansion and cold-contraction.

Similar with the method for assembling the supporting devices 31 in the first group, the method for assembling the supporting devices 32 in the second group includes the following steps: firstly, welding the base plate 321 to the outer surface of the inner container body 2 in advance, assembling the heat insulating pipe 323 at the lower portion with the predetermined length from the theoretical calculation and the fixing element 326, and pushing the elevating part 42 against the fixing element 326 to adjust the inner container body 2 to proper position, then assembling the heat insulating pipe 323 at the upper portion, and assembling the cover plate 325 with the upper fixing pipe 324 through the opening H. In an embodiment, the fixing element 326 also includes a top plate 3261 and a bending portion 3262, and the bending portion 3262 bends vertically from the edge of the top plate 3261 and towards the inner side of the high vacuum container, which is the same as the fixing element 316 in FIG. 4, and is not illustrated herein for the sake of concision.

In a preferred embodiment of the invention, among the supporting assemblies 31*a* to 31*d* and 32*a* to 32*d* in the two groups of supporting devices 31 and 32 on the inner container body 2, the supporting assemblies 31*a*, 31*b*, 32*a* and 32*b* at the upper portion of the high vacuum container are disposed at positions having angle of 45° or 135° relative to the horizontal center line L of the high vacuum container, and the supporting assemblies 31*c*, 31*d*, 32*c* and 32*d* at the lower portion of the high vacuum container are disposed at positions having angle of −60° or −120° relative to the horizontal center line L of the high vacuum container.

The assembling steps of the embodiment of the invention are shown hereinbelow:

(1) determining the theoretical distance between the inner container body and the outer container body according to the diameter of the inner container body and the diameter of the outer container body, and determining the length of each of the four heat insulating pipes 313 and 323 at the lower portion. For example, when the heat insulating pipes 313 and 323 are arranged along the radial direction, the length of each of the heat insulating pipes 313 and 323 is half of the diameter difference of the outer container body and the inner container body.

(2) before the assembling process, welding film base plates 311 and four lower fixing pipes 312 at the corresponding positions at the rear portion of the inner container body 2, in which the fixing pipes 312 are welded at the base plates 311 along the radial direction of the inner container body 2; welding four base plates 321 without the lower fixing pipes at the front position of the inner container body 2; thereby the inner container body 2 is deformable forward and backward relative to the outer container body 1, thereby eliminating the temperature stress due to heat-expansion and cold-contraction.

(3) forming a plurality of openings H on the outer container body 1 corresponding to the supporting devices, fixing the outer container body 1 to a wheel shelf or a landing device (not shown) and moving the inner container body 2 into the outer container body 1 by a rail tooling or a movable tooling.

(4) welding brackets 41 at the openings H at the lower portion of the outer container body 1, assembling the heat insulating pipes 313 and 323, the fixing elements 316 and 326 and the elevating part 42 at the lower portion, sleeving the fixing elements 316 and 326 onto the heat insulating pipes 313 and 323, adjusting front portion and the rear portion of the high vacuum container by the elevating part 42 to ensure the concentricity. The distance between the inner container body and the outer container body is precisely measured to ensure the concentricity is in the scope of ≤±5 min.

(5) after accurate adjustment, welding and fixing the lower fixing elements 316 and 326 onto the outer container body 1. Then, measuring the length of the heat insulating pipes 313 and 323 at the upper portion, and fixing the heat insulating pipes 313 and 323 with the predetermined length to the base plates 311 and 321 at the upper portion of the inner container body 2, and placing the cover plates 315 and 325 with the upper fixing pipes 314 and 324 onto the heat insulating pipes 313 and 323 at the upper portion to make the cover plates 315 and 325 conformably cover the outer container body 1, and then welding the cover plates 315 and 325 to the outer container body 1.

According to the preferred embodiment of the high vacuum container and its adjusting device, the placement of the fixing parts 316 and 326 can simplify the manufacturing process and make the connection stable. Besides, the bending portion of the fixing element sleeves onto the heat insulating pipes 313 and 323, and the top plate of the fixing element is supported by the elevating part 42, and a ±40 mm adjusting allowance, is ensured. As a result, the accurate centralized positioning of the high vacuum container is achieved. Besides, the supporting devices in the invention are not limited to be two groups, and the skilled person in the art can add more supporting devices to perform the adjusting and positioning function.

The invention can ensures the concentricity of the inner container body and the outer container body and reduces the affection to the concentricity caused by different kinds of error, taking place of un-adjustable eight-point supporting devices with an adjustable supporting structure at the lower portion of the high vacuum container. Although the invention has been described as above in reference to several typical embodiments, it is to be understood that the terms used therein are just illustrative and exemplary rather than restrictive. Since the invention can be applied in various forms without departing from the spirit or principle of the invention, it is to be understood that the abovementioned embodiments will not be limited to any specific details mentioned above, rather, they should be construed broadly in the spirit or concept of the invention defined by the appended claims. Therefore, the present invention aims to cover all the modifications or variations falling within the protection scope defined by the appended claims.

What is claimed is:

1. A high vacuum container, comprising an inner container body, an outer container body, a first group of supporting devices and a second group of supporting devices, the outer container body being provided with a plurality of openings corresponding to the first group of supporting devices and the second group of supporting devices, each group of the supporting devices including four supporting, assemblies around circumference of the high vacuum container, and two said supporting assemblies being disposed at upper portion of the high vacuum container, and the other two said supporting assemblies being disposed at lower portion of the high vacuum container, each supporting assembly including a base plate welded at outer surface of the inner container body and a heat insulating pipe extending along, a radial direction of the high vacuum container, one end of the heat insulating pipe abutting against the base plate, wherein the four supporting assemblies at the lower portion of the high vacuum container further include four fixing elements respectively, and each fixing element is partly inserted into the outer container body through the opening;

each fixing element includes a top plate and a bending portion, and the bending portion bends vertically from an edge of the top plate and towards inner part of the high vacuum container, and sleeves onto outside of the heat insulating pipe, and outer surface of the bending portion is welded to the outer container body at the opening, wherein each of the two supporting assemblies in each group of the supporting devices at upper portion of the high vacuum container comprises an upper fixing pipe and a cover plate, and the upper fixing pipe is welded to the cover plate, and the cover plate is welded to and conformably covers the outer surface of the outer container body, and the upper fixing pipe goes through the opening of the outer container body and sleeves onto outside of the other end of the heat insulating pipe, and wherein four supporting assemblies in the first group of supporting devices are disposed at a rear portion of the high vacuum container, and each of the supporting assemblies in the first group further comprises a lower fixing pipe, which is welded at the base plate and sleeves onto outside of said one end of the corresponding heat insulating pipe.

2. The high vacuum container according to claim 1, wherein the supporting assemblies in one group at the upper portion of the high vacuum container are positioned respectively with an angle of 45° or 135° relative to a horizontal center line of the high vacuum container, and the supporting assemblies in one group at the lower portion of the high vacuum container are positioned respectively with an angle of −60° or −120° relative to the horizontal center line of the high vacuum container.

3. The high vacuum container according to claim 1, wherein each fixing element is a hollow pillar with the top plate and a side wall.

4. An adjusting device for adjusting a concentricity of an inner container body relative to an outer container body of the high vacuum container according to claim 1, wherein the adjusting device comprises a bracket and an elevating part which is capable of raising and lowering the fixing element, the bracket is disposed at an outer part of the lower portion of the outer container body of the high vacuum container, and the elevating part pushes against the top plate of the fixing elements and drives the fixing elements to move.

5. A high vacuum container, comprising an inner container body, an outer container body, a first group of supporting devices and a second group of supporting devices, the outer container body being provided with a plurality of openings corresponding to the first group of supporting, devices and the second group of supporting devices, each group of the supporting devices including four supporting assemblies around circumference of the high vacuum container, and two said supporting assemblies being disposed at upper portion of the high vacuum container, and the other two said supporting assemblies being disposed at lower portion of the high vacuum container, each supporting assembly including a base plate welded at outer surface of the inner container body and a heat insulating pipe extending along a radial direction of the high vacuum container, one end of the heat insulating pipe abutting against the base plate, wherein the four supporting assemblies at the lower portion of the high vacuum container further include four fixing elements respectively, and each fixing element is partly inserted into the outer container body through the opening;

each fixing element includes a top plate and a bending portion, and the bending portion bends vertically from an edge of the top plate and towards inner part of the high vacuum container, and sleeves onto outside of the heat insulating pipe, and outer surface of the bending portion is welded to the outer container body at the opening, wherein four supporting assemblies in the first group of supporting devices are disposed at a rear portion of the high vacuum container, and each of the supporting assemblies in the first group further comprises a lower fixing pipe, which is welded at the base plate and sleeves onto outside of said one end of the corresponding heat insulating pipe.

6. The high vacuum container according to claim 5, wherein the supporting assemblies in one group at the upper portion of the high vacuum container are positioned respectively with an angle of 45° or 135° relative to a horizontal center line of the high vacuum container, and the supporting assemblies in one group at the lower portion of the high vacuum container are positioned respectively with an angle of −60° or −120° relative to the horizontal center line of the high vacuum container.

7. The high vacuum container according to claim 5, wherein each fixing element is a hollow pillar with the top plate and a side wall.

8. An adjusting device for adjusting a concentricity of an inner container body relative to an outer container body of the high vacuum container according to claim 5, wherein the adjusting device comprises a bracket and an elevating part which is capable of raising and lowering the fixing element, the bracket is disposed at an outer part of the lower portion of the outer container body of the high vacuum container, and the elevating part pushes against the top plate of the fixing elements and drives the fixing elements to move.

* * * * *